United States Patent [19]

Torres

[11] 3,993,083

[45] Nov. 23, 1976

[54] GUIDE FOR TRIMMING HAIR

[76] Inventor: Antonia Torres, 121 W. 72nd St., New York, N.Y. 10023

[22] Filed: June 13, 1975

[21] Appl. No.: 586,635

[52] U.S. Cl. ..... 132/45 R
[51] Int. Cl.[2] ..... A45D 24/36
[58] Field of Search ..... 132/45 R, 9, 7, 145; 33/174; 128/348; 30/233.5

[56] References Cited

UNITED STATES PATENTS

| | | | |
|---|---|---|---|
| 2,722,940 | 11/1955 | Bohannon | 132/45 R |
| 2,727,522 | 12/1955 | Gomme | 132/45 R |
| 2,991,790 | 7/1961 | Bonilla | 132/9 |

*Primary Examiner*—G.E. McNeill
*Attorney, Agent, or Firm*—Charles E. Baxley

[57] ABSTRACT

This disclosure teaches a guide for trimming hair. The guide enables a woman to trim her own hair and it comprises a pair of congruent rectangular plates each having a first edge hinged to that of the other. The plates are adapted to move between an open mode, wherein the plates receive a section of the hair therebetween, and a closed mode, wherein the plates align the section of hair for trimming.

1 Claim, 8 Drawing Figures

GUIDE FOR TRIMMING HAIR

BACKGROUND OF INVENTION

The present invention relates generally to a hair trimming guide for use on humans (or in some cases animals). Skill is required to space hair from a person's head for trimming, so that the hair drapes smoothly and evenly back onto the head or neck when the trimming has been completed. Various devices have been presented in the prior art to facilitate trimming of hair and to reduce the level of skill necessary for acceptable hair trimming. Attempts have been made to develop a hair trimming device by which a woman can trim her own hair, but such attempts have met with little success.

STATEMENT OF INVENTION

The present invention overcomes problems over the prior art with respect to trimming of hair in a particularly useful, novel, unobvious and facile way. A guide for trimming hair is provided which comprises a pair of congruent rectangular plates. Each of the plates has a first edge hinged to that of the other. By moving the plates between an open mode and a closed mode, a section of hair is engaged between the plates during the open mode and by moving the plates to their closed mode the section of hair is aligned for trimming.

Accordingly one object of this invention is to provide a hair cutting guide which may be applied directly to the hair to provide a guide for trimming the hair to the correct length.

Another object of this invention is to provide a hair trimming guide which is adaptable to a wide variety of hair styles and which can be employed with the hair being either wet or dry.

Still another object of this invention is to enable a woman (or man) to trim her own hair.

Still another object of this invention is to improve drape of hair back onto the head or neck after trimming.

Still another object of this invention is to provide a hair trimming guide of the type described which may be used with conventional hair dressing equipment or ordinary scissors or a razor and requiring no special apparatus for its operation.

Still another object of this invention is to provide a hair trimming guide which may be used by relatively unskilled operators to achieve correct results, and great saving of time is achieved.

Still another object of this invention is to provide a hair trimming guide which is adapted for fabrication from many different materials, so that the choice of materials can be according to the dictates of availability and price considerations, the exact size and proportions being matters easily determined to suit particularly conditions and needs.

Still another object of this invention is to provide a hair trimming guide of the aforementioned character stated which is simple, safe and convenient to operate and which will give generally efficient and desirable service.

Still another object of this invention is to provide a hair trimming guide which is suited well otherwise to its intended function.

DESCRIPTION OF DRAWINGS

The foregoing and other objects, features and advantages will appear more fully from the accompanying drawings wherein like numerical designations refer to like parts and wherein.

DESCRIPTION OF PREFERRED EMBODIMENT

Figure 1:
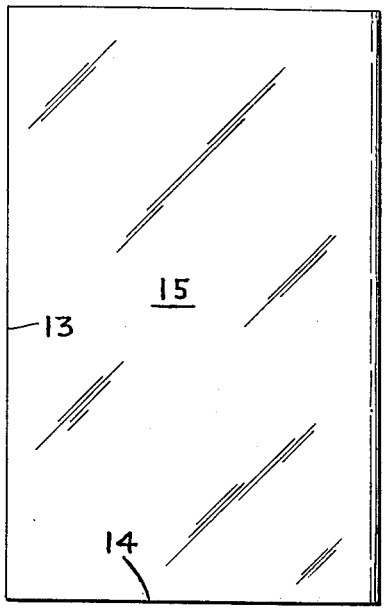
FIG. 1 is a side view of the guide.
Figure 2:
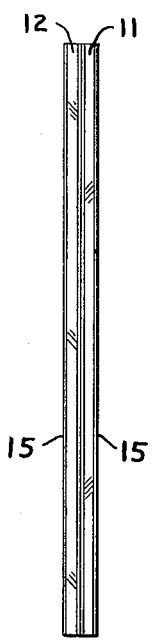
FIG. 2 is a left end view relative to FIG. 1.
Figure 3:
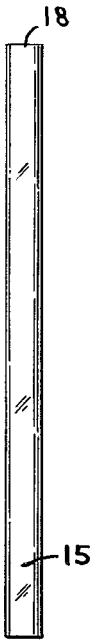
FIG. 3 is a right end view relative to FIG. 1.
Figure 4:
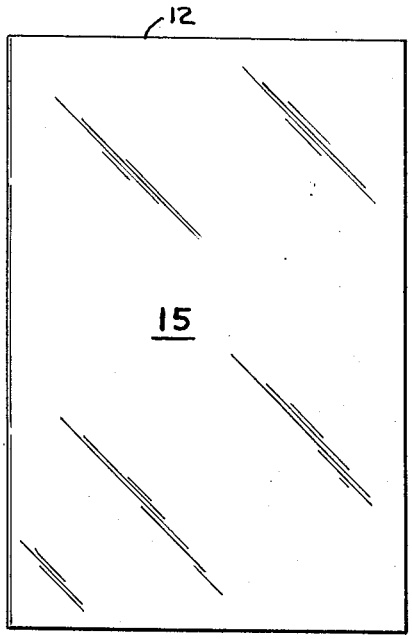
FIG. 4 is an opposite side view relative to FIG. 1.
Figure 5:
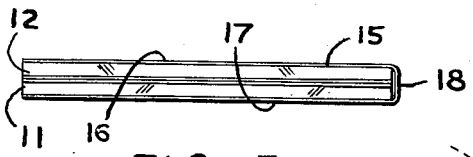
FIG. 5 is a bottom view relative to FIG. 1.

As seen in the drawings, the guide includes a first plate 11 and a second plate 12 each congruent with the other and each having a length 13 greater than its width 14. The plates 11, 12 have a fabric layer 15 glued or otherwise adhered to their outer surfaces 16, 17 and extending around one end of the plates to form a hinge 18.

Figure 6:
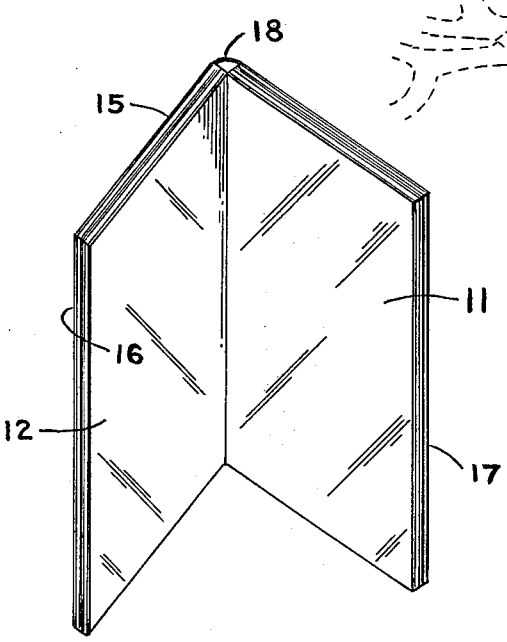
FIG. 6 is a perspective view showing the guide in its open mode.
Figure 7:
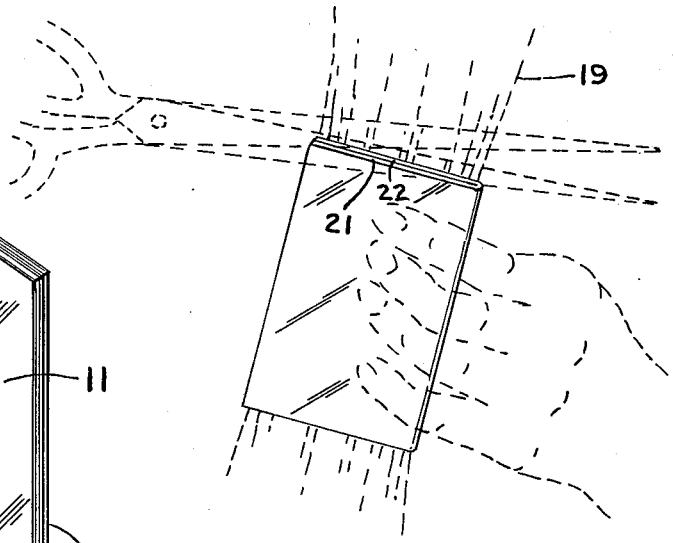
FIG. 7 is a perspective view showing the guide in its closed mode, being held by a user and with scissors in operative position to trim hair along edges of the guide.
Figure 8:
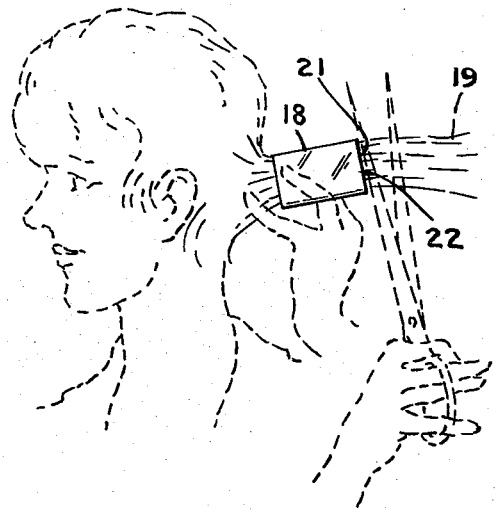
FIG. 8 depicts a woman trimming her own hair using the guide. Of course neither the scissors nor the person form a part of this invention.

The plates 11, 12 are movable about the hinge 18 between an open mode shown in FIG. 6 and a closed mode shown in FIG. 7. In the open mode the plates 11, 12 receive therebetween a section of hair 19 shown best in FIG. 7. The plates 11, 12 are then moved to their closed mode shown in FIG. 7 and the hair 19 is aligned for trimming along edges 21, 22. As seen in FIG. 8 this guide can be used with facility by a woman (or man) to trim her own hair. For men especially, use of this guide affords excellent drape of the trimmed hair back onto the wearer's neck.

It will be understood by those familiar with trimming hair that wide deviations can be made from the shown and described preferred embodiment, without departing from a main theme of invention set forth in claims which follow.

I claim:

1. A guide for trimming hair and comprising a pair of congruent rectangular plates, both of the plates substantially longer than they are wide, each of the plates having a like first edge hinged to that of the other, the plates movable about the hinge between an open mode wherein the plates receive sandwiched therebetween a section of hair and a closed mode wherein the hair is held in alignment for trimming.

* * * * *